United States Patent [19]

Glanvall

[11] Patent Number: 4,746,277

[45] Date of Patent: May 24, 1988

[54] ROTARY COMPRESSOR WITH PRESSURE PULSE SUPPRESSION

[75] Inventor: Rune V. Glanvall, Norrköping, Sweden

[73] Assignee: Stal Refrigeration AB, Norrköping, Sweden

[21] Appl. No.: 8,009

[22] Filed: Jan. 29, 1987

[30] Foreign Application Priority Data

Jan. 31, 1986 [SE] Sweden ..... 8600426

[51] Int. Cl.[4] ..... F04B 39/00; F04C 29/06

[52] U.S. Cl. ..... 417/312; 417/366; 418/181; 181/403; 62/296

[58] Field of Search ..... 417/312, 366, 410; 418/181; 62/296; 181/403

[56] References Cited

U.S. PATENT DOCUMENTS

| | | | |
|---|---|---|---|
| 2,764,342 | 9/1956 | Dills | 418/181 X |
| 4,068,987 | 1/1978 | Crooks | 418/181 |

FOREIGN PATENT DOCUMENTS

| | | | |
|---|---|---|---|
| 2455470 | 5/1975 | Fed. Rep. of Germany | 417/366 |
| 3335427 | 4/1984 | Fed. Rep. of Germany | 417/366 |
| 54-309 | 4/1979 | Japan | 418/181 |
| 46383 | 3/1984 | Japan | 417/312 |
| 182380 | 9/1985 | Japan | 418/181 |
| 256590 | 12/1985 | Japan | 418/181 |
| 383329 | 8/1973 | U.S.S.R. | 418/181 |

*Primary Examiner*—Carlton R. Croyle
*Assistant Examiner*—Paul F. Neils
*Attorney, Agent, or Firm*—Watson, Cole, Grindle & Watson

[57] ABSTRACT

In a rotary compressor for refrigeration and heat pump systems with an integrated drive motor on the high-pressure side, the operating medium will flow over the drive motor. During operating of the rotary compressor gas pulsations/pressure pulses will occur on both low-pressure and high-pressure sides. In order to suppress these pressure pulses on the high-pressure side one or more chambers with different volumes are provided, joined by channels between the discharge opening and the drive motor.

3 Claims, 1 Drawing Sheet

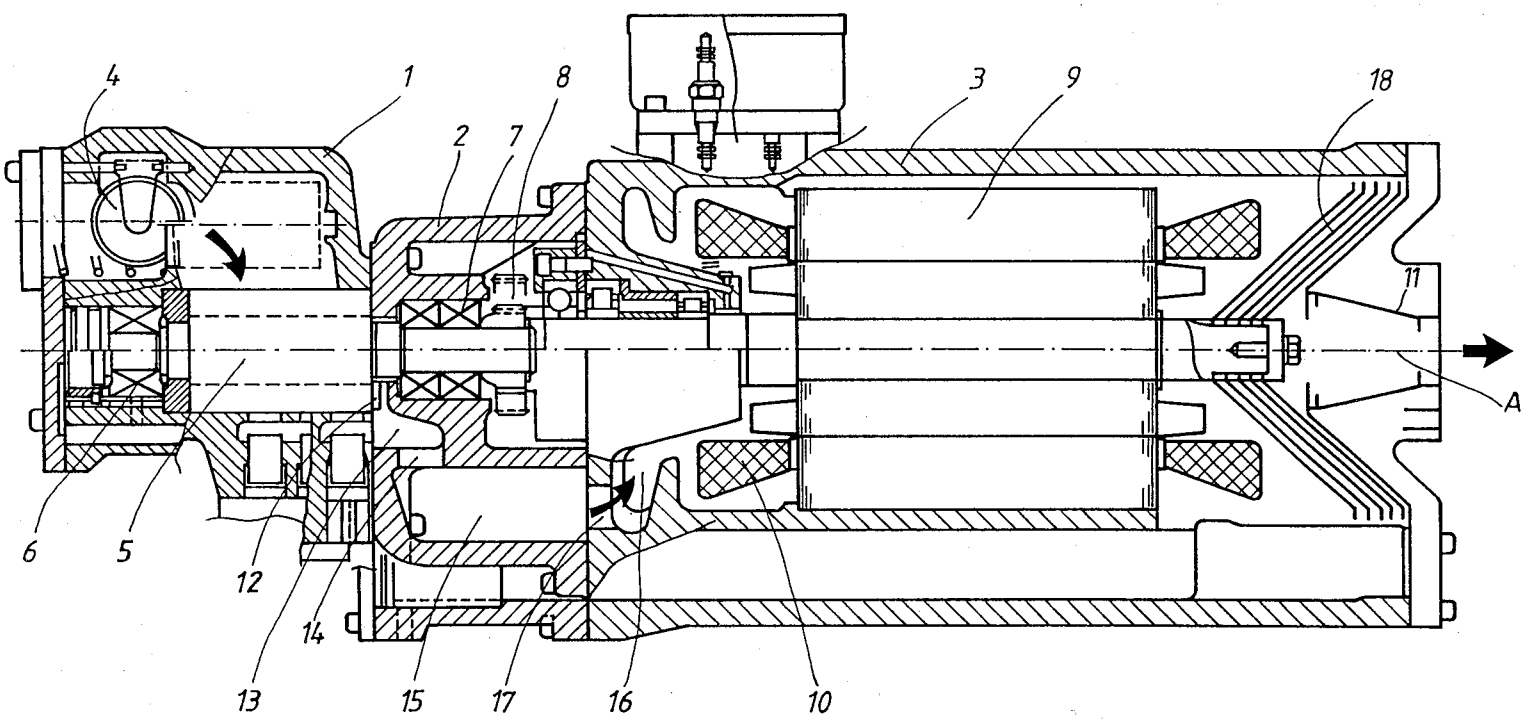
A
11
18
9
3
10
16
8
7
2
17
15
1
14
13
12
5
4
6

ROTARY COMPRESSOR WITH PRESSURE PULSE SUPPRESSION

FIELD OF THE INVENTION

The present invention relates to a rotary screw compressor for refrigeration and heat pump systems of a helical type and powered by a motor arranged in the operating medium flow after the discharge opening from the compressor.

BACKGROUND OF THE INVENTION

In a compressor operating in distinct phases, such as a piston compressor or a rotary compressor of a helical type, generally known as SRM, Lysholm, twin-screw or Globoid compressors, gas pulsations/pressure pulses will occur on both the low-pressure and the high-pressure sides. Usually these pulsations are strongest on the high-pressure side. The pulsations influence both the compressor itself and the pipes and other equipment connected thereto. The pulsations also affect the foundation and building where the compressor is located. This causes oscillations in the entire construction, which result in vibration and noise. Resonance oscillations may even occur, which will actually damage the construction.

In a closed-circuit rotary compressor the drive motor is integrated with the compressor and the operating medium flows over it. The motor may be located on the high-pressure side, that is after the compressor in the flow direction of the operating medium, in which case it will be direcly subjected to the gas pulsations mentioned above. The motor windings are mechanically relatively weak and are influenced by a pulsating magnetic field according to known patterns, as well as by the gas pulsations. The motor is housed in a relatively large casing, which is directly influenced by the pulsations that are superimposed on the high pressure. The housing may thus easily start vibrating.

Some compressors are run at different speeds, determined by the gear ratio, the pole number of the motor and the frequency of the power supply. It is thus extremely difficult to design the various elements, pressure vessel, motor windings, and so on, with resonance frequencies outside what can be considered as a risk area.

SUMMARY OF THE INVENTION

In order, in direct conjunction with the operating chamber of the compressor, to suppress pressure pulses arising in a closed-circuit rotary compressor, so that they are extinguished or are extremely weak by the time they reach elements sensitive to oscillation, for example the winding coils of the motor, the gas-flow paths between the discharge gates of the compressor and its drive motor are provided with channels communicating with spaces having different volumes.

BRIEF DESCRIPTION OF THE FIGURE

The FIGURE shows a section through a closed-circuit rotary compressor with drive motor according to a preferred embodiment of the present invention.

DESCRIPTION OF THE PREFERRED EMBODIMENT

A rotary compressor with an integrated drive motor for a refrigeration or heat pump system consists of a compressor section 1 with a rotor bearing 6 and rotors 5, an intermediate section 2 with a rotor bearing 7 and a gear 8, and a stator frame 3. A drive motor 9 has winding coils 10. The motor 9 drives the compressor rotors 5 by way of the gear 8. The motor and rotors define an axis A through the compressor section 1, the intermediate section 2 and the stator frame 3. Low-pressure gas is drawn in by way of an inlet 4 to an operating chamber in which the rotors 5 are located. The operating medium is compressed and leaves the operating chamber through a discharge gate 12, flowing out into a chamber 13. The medium then flows through a channel 14 to an equalizing chamber 15. From equalizing channel 15 the medium continues to a chamber 16 by way of a channel 17. The operating medium then flows past and through the motor 9 and an oil separator 18, leaving the compressor and motor through an outlet 11. The channels 14 and 17 define flow areas which are about the same as the flow area of the discharge gate 12.

A screw compressor of the type mentioned above has three distinct operating phases: intake - compressor - expulsion. The rotors have a number of cooperating lobes/openings, the edges of which open and close the stationary discharge gate 12. These distinct opening/-closing cycles cause the operating medium to be forced out of the chamber 13 in surges and, if no measures are taken, these pressure surges may be reproduced through the system in which the compressor is operating. To enable immediate suppression and/or extinction of these pressure surges, the chamber 13 is connected to the considerably larger chamber 15 by way of the channel 14, and this chamber 15 is connected by way of the channel 17 to at least one chamber 16 of considerably larger volume than that of the preceding chamber. The effect is increased if the flow direction of the channels 14 and 17 is altered in relation to the main direction of flow which in this case is axial.

In this regard, it can be seen that channel 12 extends perpendicularly to the axis A.

I claim:

1. In a rotary screw compressor for use in refrigeration and heat pump systems, said rotary screw compressor including an elongated housing means having an inlet port for operating medium at a low pressure and an outlet port for operating medium at a high pressure, a discharge gate located within the housing means and between the inlet port and the outlet port for dividing said housing means into a first portion and a second portion, a rotor located in the first portion of said housing means, and a drive motor for said rotor located in said second portion of said housing means, the improvement wherein said rotary screw compressor includes means in said second portion of said housing means defining first, second and third chambers between said discharge gate and said drive motor and a first channel extending between said first and second chambers and a second channel extending between said second and third chambers, said first chamber being in direct communication with said discharge gate, said second chamber having a larger volume than said first chamber and said third chamber having a larger volume than said second chamber.

2. The rotary screw compressor as defined in claim 1, wherein said discharge gate defines a flow area and wherein each of said first and second channels define flow areas generally equal to said flow area of said discharge gate.

3. The rotary screw compressor as defined in claim 1, wherein said drive motor and said rotor define an axis through said elongated housing, and wherein said first channel extends perpendicularly to said axis.

* * * * *